United States Patent [19]

Rodini

[11] Patent Number: 5,001,813

[45] Date of Patent: Mar. 26, 1991

[54] STAPLE FIBERS AND PROCESS FOR MAKING THEM

[75] Inventor: David J. Rodini, Midlothian, Va.

[73] Assignee: E. I. de Pont de Nemours and Company, Wilmington, Del.

[21] Appl. No.: 361,319

[22] Filed: Jun. 5, 1989

[51] Int. Cl.[5] ..... D01G 1/00; D02G 1/12

[52] U.S. Cl. ..... 19/0.46; 28/247; 264/137

[58] Field of Search ..... 28/247, 248; 19/0.46; 248/95, 290, 297, 87, 372, 373, 397; 264/103, 168; 68/5 D

[56] References Cited

U.S. PATENT DOCUMENTS

| | | | |
|---|---|---|---|
| 2,747,233 | 5/1956 | Hitt | 19/66 |
| 3,803,453 | 4/1974 | Hull | 317/2 R |
| 3,971,202 | 7/1976 | Windley | 57/140 BY |
| 4,085,182 | 4/1978 | Kato | 264/171 |
| 4,221,838 | 9/1980 | Hughes et al. | 19/0.46 X |
| 4,604,320 | 8/1986 | Okamoto et al. | 428/260 X |
| 4,612,150 | 9/1986 | De Howitt | 264/103 |
| 4,869,951 | 9/1989 | McCullough, Jr. et al. | 28/247 X |
| 4,900,495 | 2/1990 | Lin | 264/105 X |

*Primary Examiner*—Werner H. Schroeder
*Assistant Examiner*—John J. Calvert

[57] ABSTRACT

Staple fibers having a crimp frequency in the range of 3 to 6 crimps per centimeter are made by a process including a co-crimping step in which conductive and non-conductive filaments are crimped together.

7 Claims, No Drawings

STAPLE FIBERS AND PROCESS FOR MAKING THEM

BACKGROUND OF THE INVENTION

The field of art to which this invention pertains is staple fibers. The invention further is directed to a process for making such fibers.

More specifically, the process includes a crimping step which imparts a uniform crimp frequency in the range of 3 to 6 crimps per centimeter to a blended tow which includes difficult-to-crimp, undrawn spun-oriented sheath-core filaments having an electrically conductive carbon black core. This process enables these filaments to be crimped effectively in a manner whereby conductivity is maintained at a high level. The co-crimped tow can then be cut into suitable fibers or cutter blended with another crimped tow to form the staple fibers.

SUMMARY OF THE INVENTION

In a preferred process of this invention undrawn electrically conductive sheath/core filaments are co-crimped with poly(p-phenylene terephthalamide) filaments in the critical range previously indicated and this co-crimped tow is combined with another crimped tow of poly(m-phenylene isophthalamide) filaments, prior to cutter blending to form the staple fibers. These fibers have desired antistatic properties when used to make garments.

The invention further is directed to a process for making a blend of staple fibers suitable for making permanently antistatic fabrics including the steps of:

forming a blended tow by combining a plurality of undrawn, spin-oriented sheath-core filaments having an electrically conductive carbon black core and a sheath of a nonconductive polymer with a plurality of monocomponent nonconductive filaments crimping the blended tow to produce a co-crimped blended tow in which the filaments forming the tow have a uniform crimp frequency in the range of 3 to 6 crimps per centimeter and then cutting the co-crimped blended tow to form an intimate blend of conductive and nonconductive staple fibers.

In this embodiment, the monocomponent nonconductive filaments are such that they are capable, when in the form of a tow, of being stuffer-box crimped to a uniform crimp frequency in the range of 3 to 6 crimps per centimeter. Further, the blended tow described above is preferably crimped in a stuffer-box crimper to produce a co-crimped blended tow in which all of the filaments forming the tow have a uniform crimp frequency in the range of 3 to 6 crimps per centimeter.

More specifically, this invention is a process for making a three-component blend of staple fibers suitable for making a permanently antistatic fabric which includes the steps of:

forming a plurality of undrawn spin-oriented sheath-core filaments having an electrically conductive carbon black core and a sheath of a nonconductive polymer into a first component yarn forming a plurality of nonconductive continuous poly(p-phenylene terephthalamide) filaments into a second component yarn combining the first and second component yarns into a first tow crimping the first tow, wherein such crimped tow has between 3 and 6 crimps per centimeter forming a plurality of nonconductive poly(m-phenylene isophthalamide) filaments or fibers into a third component second tow crimping the second tow, wherein such tow has between 3 and 6 crimps per centimeter combining the crimped first and second tows and cutting the combined tows to form a three-component blend of staple fibers suitable for use in making a permanently antistatic fabric.

The staple fibers made by these processes are also a part of this invention.

Preferably such fibers contain from about 1 to 5 wt. % of the conductive fibers and the monocomponent nonconductive fibers include both poly(p-phenylene terephthalamide) fibers and poly(m-phenylene isophthalamide) fibers.

Lastly, this invention includes staple fibers suitable for use in making a permanently antistatic fabric made by cutter blending a co-crimped tow of poly(p-phenylene terephthalamide filaments and undrawn, spin-oriented sheath-core filaments having an electrically conductive carbon black core and a sheath of a nonconductive polymer and a crimped tow of poly(m-phenylene isophthalamide) filaments.

DESCRIPTION OF THE PREFERRED EMBODIMENTS

The crimped staple fibers of this invention may be made into spun yarns, which can then be made into fabrics having permanent antistatic properties. The crimping is preferably accomplished in a stuffer box crimper of the type described in Hitt, U.S. Pat. No. 2,747,233 the teachings of which are incorporated herein by reference.

The antistatic properties are imparted to the fabric by the undrawn sheath-core fibers. The filaments from which these fibers are made are difficult to crimp and are frequently damaged to a point where their conductivity capabilities are diminished to an undesirable level. Further, the crimping frequency is often at too high a level, e.g. of the order of 40 crimps per centimeter, or not sufficiently uniform. The process of the instant invention solves these problems and in so doing provides an improved staple fiber blend made from conductive and nonconductive filaments ideally suited for making garments having permanent antistatic properties.

The undrawn conductive sheath-core filaments which play such a significant role in this invention can be made by the process described, in detail, in De Howitt, U.S Pat. No. 4,612,150 the teachings of which are incorporated herein by reference; except that the conductive filaments in the present invention are not drawan, These undrawn conductive filaments have thick sheaths, which diminish the dark appearance of the carbon black conductive core in the final fabric. Further, these filaments after further processing are capable of imparting the desired antistatic properties sought in the garment. This capability would be lost or substantially reduced if these conductive filaments in tow form were crimped alone in a stuffer box crimper prior to being processed into staple fibers. By co-crimping them with the nonconductive filaments in accordance with this invention, that capability is maintained. As so crimped, the co-crimped tow has a crimp frequency of 3 to 6 uniform crimps per centimeter. This range effectively holds the conductive and nonconductive filaments together in the stuffer box crimper and in the cutter and in subsequent processing without damaging the core of the conductive filaments.

The following examples further describe the novel processes and staple fibers of the invention.

EXAMPLE 1

A blended tow of undrawn, spin-oriented electrically conductive sheath-core filaments and poly(p-phenylene terephthalamide) (PPD-T) filaments were crimped together.

The undrawn, spin-oriented electrically conductive sheath-core filaments were supplied as yarn packages of three-filament yarns of sheath-core filaments having a core of polyethylene resin containing about 28 wt. % electrically conductive carbon black and a sheath of polyhexamethylene adipamide, prepared substantially as described in Example 1 (Col. 3, lines 7–68) of De Howitt U.S. Pat. No. 4,612,150. The filaments had a linear density of 10.3 decitex (dtex) per filament (9.33 denier per filament=9.33 dpf).

The PPD-T filaments were supplied as yarn packages of 1000-filament yarns of PPD-T filaments having a linear density of 1.65 dtex per filament (1.5 dpf) and a modulus of about 515 g/dtex (available as Type 29 "Kevlar" aramid fiber from E. I. du Pont de Nemours and Co.).

Seventy-two packages of the 3-filament sheath-core yarn were combined to form a 216-filament yarn, and nineteen packages of the 216-filament sheath-core yarn were mounted on a creel together with seventy-two packages of the 1000-filament PPD-T yarn. The yarns on all of these packages were combined to form a tow of 4104 of the 10.3 dtex sheath-core filaments and 72,000 of the 1.65 dtex PPD-T filaments. This tow was fed into a stuffer-box crimper of the general type shown in U.S. Pat. No. 2,747,233 at a speed of 160 mpm (175 ypm), wherein the tow received a uniform crimp of 4.3 crimps per cm (11 crimps per in). The co-crimped tow was piddled into containers.

Two ends of the co-crimped tow prepared as described above were combined with four ends of a separately crimped poly(m-phenylene isophthalamide) (MPD-I) tow, each end of MPD-I tow containing about 647,000 filaments having a linear density of 1.9 dtex/filament (1.7 dpf) and crimped to about 4.3 crimps per cm. The combined tow was fed at a speed of 200 mpm into a cutter, wherein the filaments were cut to an intimate blend of staple fibers having a cut length of 5.1 cm (2 inches).

The intimate blend of staple fibers was made into spun yarns, which were then made into fabrics. The fabrics were found to be permanently antistatic.

EXAMPLE 2

The preparation of the co-crimped tow of Example 1 was repeated, except that only sixteen packages of the 216-filament sheath-core yarn and only fifty-seven packages of a 1000-filament, sage green producer colored PPD-T yarn were mounted on the creel; the yarns on all of these packages being combined to form a tow of 3456 of the 10.3 dtex bicomponent filaments and 57,000 of the 1.65 dtex sage green PPD-T filaments. This tow was fed into the stuffer-box crimper at a speed of 160 mpm (175 ypm), wherein the tow received a uniform crimp of 4.3 crimps per cm (11 crimps per in). The co-crimped tow was piddled into containers.

The co-crimped tow was cut to staple fibers having a cut length of 7.6 cm (3 inches) and processed into a sliver using a worsted system. This sliver was blended with stretch-broken slivers of blue gray MPD-I and sage green PPD-T staple fibers to give a final intimate staple fiber blend consisting of 2 wt. % of the sheath-core staple fibers, 78 wt. % of the blue gray MPD-I staple fibers, and 20 wt. % of the sage green PPD-T staple fibers.

The intimate blend of staple fibers was made into spun yarns, which were then made into fabrics. The fabrics were found to be permanently antistatic.

What is claimed is:

1. A process for making a blend of staple fibers suitable for making permanently antistatic fabrics including the steps of:

forming a blended tow by combining a plurality of undrawn, spin-oriented sheath-core filaments having an electrically conductive carbon black core and a sheath of a nonconductive polymer with a plurality of monocomponent nonconductive filaments crimping the blended tow to produce a co-crimped blended tow in which the filaments forming the tow have a uniform crimp frequency in the range of 3 to 6 crimps per centimeter and then cutting the co-crimped blended tow to form an intimate blend of conductive and nonconductive staple fibers.

2. A process for making a blend of staple fibers suitable for making permanently antistatic fabrics including the steps of:

forming a blended tow by combining a plurality of undrawn, spin-oriented sheath-core filaments having an electrically conductive carbon black core and a sheath of a nonconductive polymer with a plurality of monocomponent nonconductive filaments, said monocomponent nonconductive filaments being capable when in the form of a tow of being stuffer-box crimped to a uniform crimp frequency in the range of 3 to 6 crimps per centimeter crimping the blended tow in a stuffer-box crimper to produce a co-crimped blended tow in which the filaments forming the tow have a uniform crimp frequency in the range of 3 to 6 crimps per centimeter and then cutting the co-crimped blended tow to form an intimate blend of conductive and nonconductive staple fibers.

3. The process of claim 1 wherein the undrawn, spin-oriented sheath-core filaments comprise a core of polyethylene resin containing electrically conductive carbon black substantially surrounded by a sheath of polyhexamethylene adipamide.

4. The process of claim 1 wherein the co-crimped blended tow is cutter blended with another crimped tow having substantially the same crimp frequency.

5. The process of claim 1 wherein there are more monocomponent nonconductive filaments than sheath-core filaments in the tow.

6. The process of claim 1 wherein the monocomponent filaments are poly(p-phenylene terephthalamide) filaments.

7. Staple fibers made by the process of claim 1.

* * * * *